US006875400B2

(12) United States Patent
Speer et al.

(10) Patent No.: US 6,875,400 B2
(45) Date of Patent: Apr. 5, 2005

(54) METHOD OF STERILIZING AND INITIATING A SCAVENGING REACTION IN AN ARTICLE

(75) Inventors: Drew V. Speer, Simpsonville, SC (US); Ronald L. Cotterman, Greenville, SC (US)

(73) Assignee: Cryovac, Inc., Duncan, SC (US)

( * ) Notice: Subject to any disclaimer, the term of this patent is extended or adjusted under 35 U.S.C. 154(b) by 364 days.

(21) Appl. No.: 09/860,389

(22) Filed: May 18, 2001

(65) Prior Publication Data

US 2002/0153511 A1 Oct. 24, 2002

Related U.S. Application Data

(60) Provisional application No. 60/258,030, filed on Dec. 22, 2000.

(51) Int. Cl.[7] ..... A61L 2/00

(52) U.S. Cl. ..... 422/22; 252/181; 252/188.28; 422/1; 422/23; 422/40

(58) Field of Search ..... 422/1, 22, 23, 422/40; 252/181, 188.28

(56) References Cited

U.S. PATENT DOCUMENTS

| | | | | |
|---|---|---|---|---|
| 3,670,874 | A | 6/1972 | Brunner | 206/46 PV |
| 5,211,875 | A | 5/1993 | Speer et al. | 252/188.28 |
| 5,310,497 | A | 5/1994 | Ve Speer et al. | 252/188.28 |
| 5,350,622 | A | 9/1994 | Speer et al. | 428/215 |
| 5,583,047 | A | 12/1996 | Blinka et al. | 436/5 |
| 5,834,079 | A | 11/1998 | Blinka et al. | 428/35.7 |
| 5,859,145 | A | 1/1999 | Ching et al. | 525/330.6 |
| 5,904,960 | A | 5/1999 | Becraft et al. | 427/558 |
| 6,214,254 | B1 | 4/2001 | Gauthier et al. | 252/188.28 |

FOREIGN PATENT DOCUMENTS

| | | |
|---|---|---|
| JP | 07 186337 A | 7/1995 |
| WO | WO 94/06626 | 3/1994 |
| WO | WO 95/33651 | 12/1995 |
| WO | WO 96/08371 | 3/1996 |
| WO | WO 97/07161 | 2/1997 |
| WO | WO 97/44364 | 11/1997 |
| WO | WO 98/05555 | 2/1998 |
| WO | WO 98/05571 | 2/1998 |
| WO | WO 98/51758 | 11/1998 |
| WO | WO 98/51759 | 11/1998 |
| WO | WO 99/48963 | 9/1999 |

OTHER PUBLICATIONS

English language abstract, JP 2002128029A; "Sterilization of packaging component . . . ";2000.10.20; Toyo Seikan Kaisha LTD (TOXO).

*Primary Examiner*—Krisanne Jastrzab
(74) *Attorney, Agent, or Firm*—Mark B. Quatt

(57) ABSTRACT

A method includes providing an article including an oxygen scavenger; forming the article into a container; placing an oxygen sensitive product into the container; and exposing the container to actinic radiation at a dosage effective to sterilize the container, and trigger the oxygen scavenger in the article. Alternative methods are also disclosed. A package includes a container, the container including an activated oxygen scavenger; wherein the container is sterilized; and wherein an oxygen sensitive product is disposed in the container.

19 Claims, No Drawings

METHOD OF STERILIZING AND INITIATING A SCAVENGING REACTION IN AN ARTICLE

This application claims the benefit of U.S. Provisional Application No. 60/258,030, filed Dec. 22, 2000.

FIELD OF THE INVENTION

The invention generally relates to a method of initiating an oxygen scavenging reaction in an article during a gamma sterilization process typical of those used for medical products.

BACKGROUND OF THE INVENTION

A number of sterilization processes are used in the health care industry, including gamma radiation, ethylene oxide treatment, and steam (thermal) treatment. In the food industry, retort processes, gamma radiation, electron beam radiation and microwave radiation are used. For the packaging of intravenous solutions and the like, sterilization of the primary packaging material is critical.

Many medical products such as intravenous solutions are oxygen sensitive and therefore it is desirable to use oxygen scavengers in their packaging. It would be desirable to conveniently and simply supply a single packaging material which can be sterilized by gamma radiation for medical applications, and which includes an oxygen scavenger which is triggered or activated by the same gamma ray sterilization that is used to sterilize the packaging material. This would then avoid the need for a separate triggering step, or for a separate insertion of an oxygen scavenger in a resulting package, or for a master pack and separate individual packets.

Incorporating an oxygen scavenger into the packaging material itself achieves a more uniform scavenging effect throughout the package. This may be especially important where there is restricted air circulation inside the package. In addition, such incorporation can provide a means of intercepting and scavenging oxygen as it passes through the walls of the package, thereby maintaining the lowest possible oxygen level throughout the package.

Oxygen scavengers suitable for commercial use in articles of the present invention, such as films, are disclosed in U.S. Pat. No. 5,350,622, and a method of initiating oxygen scavenging generally is disclosed in U.S. Pat. No. 5,211,875. These applications are incorporated herein by reference in their entirety. According to U.S. Pat. No. 5,350,622, oxygen scavengers are made of an ethylenically unsaturated hydrocarbon and transition metal catalyst. The ethylenically unsaturated hydrocarbon may be either substituted or unsubstituted. As defined herein, an unsubstituted ethylenically unsaturated hydrocarbon is any compound that possesses at least one aliphatic carbon-carbon double bond and comprises 100% by weight carbon and hydrogen. A substituted ethylenically unsaturated hydrocarbon is defined herein as an ethylenically unsaturated hydrocarbon which possesses at least one aliphatic carbon-carbon double bond and comprises about 50%–99% by weight carbon and hydrogen. Preferable substituted or unsubstituted ethylenically unsaturated hydrocarbons are those having two or more ethylenically unsaturated groups per molecule. More preferred is a polymeric compound having three or more ethylenically unsaturated groups and a molecular weight equal to or greater than 1,000 weight average molecular weight.

Examples of unsubstituted ethylenically unsaturated hydrocarbons include, but are not limited to, diene polymers such as polyisoprene (e.g. trans-polyisoprene) and copolymers thereof, cis and trans 1,4-polybutadiene, 1,2-polybutadiene, (which is defined as a polybutadiene possessing greater than or equal to 50% 1,2 microstructure), and copolymers thereof, such as styrene-butadiene copolymer. Such hydrocarbons also include polymeric compounds such as polypentenamer, polyoctenamer, and other polymers prepared by cyclic olefin metathesis; diene oligomers such as squalene; and polymers or copolymers with unsaturation derived from dicyclopentadiene, norbornadiene, 5-ethylidene-2-norbornene, 5-vinyl-2-norbornene, 4-vinylcyclohexene, 1,7-octadiene, or other monomers containing more than one carbon-carbon double bond (conjugated or non-conjugated).

Examples of substituted ethylenically unsaturated hydrocarbons include, but are not limited to, those with oxygen-containing moieties, such as esters, carboxylic acids, aldehydes, ethers, ketones, alcohols, peroxides, and/or hydroperoxides. Specific examples of such hydrocarbons include, but are not limited to, condensation polymers such as polyester derived from a monomer containing a carbon-carbon double bond, and unsaturated fatty acids such as oleic, ricinoleic, dehydrated ricinoleic, and linoleic acid and derivatives thereof, e.g. esters. Such hydrocarbons also include polymers or copolymers derived from (meth)allyl (meth)acrylates. Suitable oxygen scavenging polymers can be made by trans-esterification. Such polymers are disclosed in U.S. Pat. No. 5,859,145 (Ching et al.) (Chevron Research and Technology Company), incorporated herein by reference as if set forth in full. The composition used may also comprise a mixture of two or more of the substituted or unsubstituted ethylenically unsaturated hydrocarbons described above. While a weight average molecular weight of 1,000 or more is preferred, an ethylenically unsaturated hydrocarbon having a lower molecular weight is usable, especially if it is blended with a film-forming polymer or blend of polymers.

Ethylenically unsaturated hydrocarbons which are appropriate for forming solid transparent layers at room temperature are preferred for scavenging oxygen in the packaging articles described above. For most applications where transparency is necessary, a layer which allows at least 50% transmission of visible light is preferred.

When making transparent oxygen-scavenging layers according to this invention, 1,2-polybutadiene is useful at room temperature. For instance, 1,2-polybutadiene can exhibit transparency, mechanical properties and processing characteristics similar to those of polyethylene. In addition, this polymer is found to retain its transparency and mechanical integrity even after most or all of its oxygen uptake capacity has been consumed, and even when little or no diluent resin is present. Even further, 1,2-polybutadiene exhibits a relatively high oxygen uptake capacity and, once it has begun to scavenge, it exhibits a relatively high scavenging rate as well.

When oxygen scavenging at low temperatures is desired, 1,4-polybutadiene, and copolymers of styrene with butadiene, and styrene with isoprene are useful. Such compositions are disclosed in U.S. Pat. No. 5,310,497 issued to Speer et al. on May 10, 1994 and incorporated herein by reference as if set forth in full. In many cases it may be desirable to blend the aforementioned polymers with a polymer or copolymer of ethylene.

An additional example of oxygen scavengers which can be used in connection with this invention are disclosed in PCT patent publication WO 99/48963 (Chevron Chemical et al.). These oxygen scavengers include a polymer or oligomer having at least one cyclohexene group or functionality. These oxygen scavengers include a polymer having a polymeric backbone, cyclic olefinic pendent group, and linking group linking group linking the olefinic pendant group to the polymeric backbone.

An oxygen scavenger suitable for use with the invention comprises:

(a) a polymer or lower molecular weight material containing substituted cyclohexene functionality according to the following diagram:

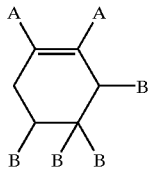

where A may be hydrogen or methyl and either one or two of the B groups is a heteroatom-containing linkage which attaches the cyclohexene ring to the said material, and wherein the remaining B groups are hydrogen or methyl;

(b) a transition metal catalyst; and optionally (c) a photoinitiator.

The composition may be polymeric in nature or it may be a lower molecular weight material. In either case it may be blended with one or more further polymers or other additives. In the case of low molecular weight materials, the above composition is preferably compounded with a carrier resin before use.

When used in forming a packaging article, the oxygen scavenger used in connection with the present invention can include only the above-described polymers and a transition metal catalyst. However, photoinitiators can be added to further facilitate and control the initiation of oxygen scavenging properties. Adding a photoinitiator or a blend of photoinitiators to the oxygen scavenging composition can be preferred, especially where antioxidants have been added to prevent premature oxidation of the composition during processing and storage.

Suitable photoinitiators are known to those skilled in the art. See, e.g., PCT publication WO 97/07161, WO 97/44364, WO 98/51758, and WO 98/51759 the teachings of which are incorporated herein by reference as if set forth in full. Specific examples of suitable photoinitiators include, but are not limited to, benzophenone, and its derivatives, such as methoxybenzophenone, dimethoxybenzophenone, dimethylbenzophenone, diphenoxybenzophenone, allyloxybenzophenone, diallyloxybenzophenone, dodecyloxybenzophenone, dibenzosuberone, 4,4'-bis(4-isopropylphenoxy)benzophenone, 4-morpholinobenzophenone, 4-aminobenzophenone, tribenzoyl triphenylbenzene, tritoluoyl triphenylbenzene, 4,4'-bis(dimethylamino)-benzophenone, acetophenone and its derivatives, such as, o-methoxy-acetophenone, 4'-methoxyacetophenone, valerophenone, hexanophenone, α-phenyl-butyrophenone, p-morpholinopropiophenone, benzoin and its derivatives, such as, benzoin methyl ether, benzoin butyl ether, benzoin tetrahydropyranyl ether, 4-o-morpholinodeoxybenzoin, substituted and unsubstituted anthraquinones, α-tetralone, acenaphthenequinone, 9-acetylphenanthrene, 2-acetyl-phenanthrene, 10-thioxanthenone, 3-acetyl-phenanthrene, 3-acetylindole, 9-fluorenone, 1-indanone, 1,3,5-triacetylbenzene, thioxanthen-9-one, isopropylthioxanthen-9-one, xanthene-9-one, 7-H-benz[de]anthracen-7-one, 1'-acetonaphthone, 2'-acetonaphthone, acetonaphthone, benz[a]anthracene-7,12-dione, 2,2-dimethoxy-2-phenylacetophenone, α,α-diethoxyacetophenone, α,α-dibutoxyacetophenone, 4-benzoyl-4'-methyl(diphenyl sulfide) and the like. Single oxygen-generating photosensitizers such as Rose Bengal, methylene blue, and tetraphenylporphine as well as polymeric initiators such as poly(ethylene carbon monoxide) and oligo[2-hydroxy-2-methyl-1-[4-(1-methylvinyl)phenyl] propanone] also can be used. However, photoinitiators are preferred because they generally provide faster and more efficient initiation. When actinic radiation is used, photoinitiators also can provide initiation at longer wavelengths which are less costly to generate and present less harmful side effects than shorter wavelengths.

When a photoinitiator is present, it can enhance and/or facilitate the initiation of oxygen scavenging by the oxygen scavenger upon exposure to radiation. The appropriate amount of photoinitiator depends on the amount and type of cyclic unsaturation present in the polymer, the wavelength and intensity of radiation used, the nature and amount of antioxidants used, and the type of photoinitiator used. The amount of photoinitiator also can depend on how the scavenging composition is used. For instance, if a photoinitiator-containing composition is in a film layer, which underneath another layer is somewhat opaque to the radiation used, more initiator might be needed. However, the amount of photoinitiator used for most applications ranges from about 0.01 to about 10% (by wt.) of the total composition. Oxygen scavenging can be initiated by exposing an article containing the oxygen scavenger to actinic or electron beam radiation, as described below.

Also suitable for use in the present invention is the oxygen scavenger of copending U.S. patent application Ser. No. 09/350336, filed Jul. 9, 1999, incorporated herein by reference in its entirety, which discloses a copolymer of ethylene and a strained, cyclic alkylene, preferably cyclopentene; and a transition metal catalyst.

Another oxygen scavenger which can be used in connection with this invention is the oxygen scavenger of U.S. Pat. No. 6,214,254 (Gauthier et al.), incorporated herein by reference in its entirety, which discloses ethylene/vinyl aralkyl copolymer and a transition metal catalyst.

As indicated above, the ethylenically unsaturated hydrocarbon is combined with a transition metal catalyst. Suitable metal catalysts are those which can readily interconvert between at least two oxidation states.

Preferably, the catalyst is in the form of a transition metal salt, with the metal selected from the first, second or third transition series of the Periodic Table. Suitable metals include, but are not limited to, manganese II or III, iron II or III, cobalt II or III, nickel II or III, copper I or II, rhodium II, III or IV, and ruthenium II or III. The oxidation state of the metal when introduced is not necessarily that of the active form. The metal is preferably iron, nickel or copper, more preferably manganese and most preferably cobalt. Suitable counterions for the metal include, but are not limited to, chloride, acetate, stearate, palmitate, caprylate, linoleate, tallate, 2-ethylhexanoate, neodecanoate, oleate or naphthenate. Particularly preferable salts include cobalt (II) 2-ethylhexanoate, cobalt stearate, and cobalt (II) neodecanoate. The metal salt may also be an ionomer, in which case a polymeric counterion is employed. Such ionomers are well known in the art.

Any of the above-mentioned oxygen scavengers and transition metal catalyst can be further combined with one or more polymeric diluents, such as thermoplastic polymers which are typically used to form film layers in plastic packaging articles. In the manufacture of certain packaging articles well known thermosets can also be used as the polymeric diluent.

Polymers which can be used as the diluent include, but are not limited to, polyethylene terephthalate (PET), polyethylene, low or very low density polyethylene, ultra-low density polyethylene, linear low density polyethylene, polypropylene, polyvinyl chloride, polystyrene, and ethylene copolymers such as ethylene-vinyl acetate, ethylene-alkyl (meth)acrylates, ethylene-(meth)acrylic acid and ethylene-(meth)acrylic acid ionomers. Blends of different diluents may also be used. However, as indicated above, the selection of the polymeric diluent largely depends on the article to be manufactured and the end use. Such selection factors are well known in the art.

Further additives can also be included in the composition to impart properties desired for the particular article being manufactured. Such additives include, but are not necessarily limited to, fillers, pigments, dyestuffs, antioxidants, stabilizers, processing aids, plasticizers, fire retardants, anti-fog agents, etc.

The mixing of the components listed above is preferably accomplished by melt-blending at a temperature in the range of 50° C. to 300° C. However, alternatives such as the use of a solvent followed by evaporation may also be employed. The blending may immediately precede the formation of the finished article or preform or precede the formation of a feedstock or masterbatch for later use in the production of finished packaging articles.

Oxygen scavenging structures can sometimes generate reaction byproducts, which can adversely affect the packaged material or raise food regulatory issues. These by-products can include organic acids, aldehydes, ketones, and the like. This problem can be minimized by the use of polymeric functional barriers.

Polymeric functional barriers for oxygen scavenging applications are disclosed in WO 96/08371 to Ching et al.(Chevron Chemical Company), and WO 94/06626 to Balloni et al. Functional barriers are also disclosed in copending U.S. patent application Ser. Nos. 08/813752 (Blinka et al.) and 09/445645 (Miranda), all of which are incorporated herein by reference as if set forth in full. The materials in these publications and applications collectively include high glass transition temperature ($T_g$) glassy polymers such as polyethylene terephthalate (PET) and nylon 6 that are preferably further oriented; low $T_g$ polymers and their blends; a polymer derived from a propylene monomer; a polymer derived from a methyl acrylate monomer; a polymer derived from a butyl acrylate monomer; a polymer derived from a methacrylic acid monomer; polyethylene terephthalate glycol (PETG); amorphous nylon; ionomer; a polymeric blend including a polyterpene; and poly (lactic acid). The functional barrier polymer(s) may further be blended with another polymer to modify the oxygen permeability as required by some applications. The functional barriers can be incorporated into one or more layers of a multilayer film, container, or other article that includes an oxygen scavenging layer.

In certain applications of oxygen scavenging, it is desirable to provide polymeric materials with low oxygen transmission rates, i.e. with high barrier to oxygen. In these cases, it is preferred that the oxygen permeability of the barrier be less than 500 $cm^3O_2/m^2$·day·atmosphere (tested at 1 mil thick and at 25° C. according to ASTM D3985), preferably less than 100, more preferably less than 50 and most preferably less than 25 $cm^3O_2/m^2$·day·atmosphere such as less than 10, less than 5, and less than 1 $cm^3O_2/m^2$·day·atmosphere. The exact oxygen permeability optimally required for a given application can readily be determined through experimentation by one skilled in the art. In medical applications, high barrier is often required to protect the quality of the product being packaged over the intended lifetime of the product. Higher oxygen permeability can readily be accomplished by blending the barrier polymer with any polymer that has a substantially higher oxygen permeability. Useful polymers for blending with barrier polymers include but are not limited to polymers and copolymers of alkyl acrylates, especially ethylene/butyl acrylate; ethylene/vinyl acetate copolymers; and the like. In addition to blending, one skilled in the art will recognize that the barrier can be adjusted through the specification of the resin and thickness.

DEFINITIONS

"Film" herein means a film, laminate, sheet, web, coating, or the like which can be used to package a product.

"Oxygen scavenger" (OS) and the like herein means a composition, article or the like which consumes, depletes or reacts with oxygen from a given environment.

"Functional barrier" herein means a polymeric material, which acts as a selective barrier to by-products from the oxygen scavenging reaction, but is not itself a significant barrier to oxygen.

"LLDPE" herein means linear low density polyethylene, which is an ethylene/alpha-olefin copolymer.

"EVOH" herein means ethylene/vinyl alcohol copolymer.

"EVA" herein means ethylene/vinyl acetate copolymer.

"Polymer" and the like herein means a homopolymer, but also copolymers thereof, including bispolymers, terpolymers, etc.

"Ethylene/alpha-olefin copolymer" and the like herein means such heterogeneous materials as linear low density polyethylene (LLDPE), linear medium density polyethylene (LMDPE) and very low and ultra low density polyethylene (VLDPE and ULDPE); and homogeneous polymers such as metallocene catalyzed polymers such as EXACT (TM) materials supplied by Exxon, and TAFMER (TM) materials supplied by Mitsui Petrochemical Corporation. These materials generally include copolymers of ethylene with one or more comonomers selected from $C_4$ to $C_{10}$ alpha-olefins such as butene-1 (i.e., 1-butene), hexene-1, octene-1, etc. in which the molecules of the copolymers comprise long chains with relatively few side chain branches or cross-linked structures. This molecular structure is to be contrasted with conventional low or medium density polyethylenes which are more highly branched than their respective counterparts. Other ethylene/a-olefin copolymers, such as the long chain branched homogeneous ethylene/a-olefin copolymers available from the Dow Chemical Company, known as AFFINITY (TM) resins, are also included as another type of ethylene alpha-olefin copolymer useful in the present invention. It is further contemplated that single-site catalyzed polyethylenes, known as Versipol™ (DuPont), will be useful in the present invention.

"Polyamide" and the like herein means any polymer having amide linkages along the molecular chain, and preferably to synthetic polyamides such as nylons. Furthermore, such term encompasses both polymers comprising repeating units derived from monomers, such as caprolactam, which polymerize to form a polyamide, as well as polymers derived from a diacid and diamine and copolymers of two or more amide monomers, including nylon terpolymers, also referred to generally as "copolyamides" herein.

"Medical product" and the like herein means any product which is preferably sterilized prior to use in health care, whether for medical, dental, or veterinary applications, such as those used during medical intervention. This is exemplified but not limited to needles, syringes, sutures, wound dressings such as bandages, general wound dressings, non-adherent dressings, burn dressings, surgical tools such as scalpels, gloves, drapes, and other disposal items, solutions, ointments, antibiotics, antiviral agents, blood components such as plasma, drugs, biological agents, intravenous solutions, saline solutions, surgical implants, surgical sutures, stents, catheters, vascular grafts, artificial organs, cannulas, wound care devices, dialysis shunts, wound drain tubes, skin sutures, vascular grafts, implantable meshes, intraocular devices, heart valves, biological graft materials, tape closures and dressings, head coverings, shoe coverings, sterilization wraps, and the like.

"Trigger" and the like herein means that process defined in U.S. Pat. No. 5,211,875, whereby oxygen scavenging is initiated (i.e. activated) by exposing an article such as a film to actinic radiation, such as ionizing radiation, such as gamma radiation, having a wavelength of less than about 750 nm at an intensity of at least about 1.6 $mW/cm^2$ or an electron beam at a dose of at least 0.2 megarads (MR), wherein after initiation the oxygen scavenging rate of the article is at least about 0.05 cc oxygen per day per gram of oxidizable organic compound for at least two days after oxygen scavenging is initiated. Preferred is a method offering a short "induction period" (the time that elapses, after exposing the oxygen scavenging component to a source of actinic radiation, before initiation of the oxygen scavenging activity begins) so that the oxygen scavenging component can be activated at or immediately prior to use during filling and sealing of a container, made wholly or partly from the article, with an oxygen sensitive material.

Thus, "trigger" refers to exposing an article to actinic radiation as described above; "initiation" refers to the point in time at which oxygen scavenging actually begins or is activated; and "induction time" refers to the length of time, if any, between triggering and initiation.

"Sterilize" and the like herein means the effective inactivation or kill of microbes contained in or on a product. The level of inactivation or kill may vary, but it will be in an amount or at a level acceptable by the applicable commercial and/or FDA standards for the intended product.

SUMMARY OF THE INVENTION

In one aspect of the invention, a method comprises providing an article comprising an oxygen scavenger; forming the article into a container; placing an oxygen sensitive product into the formed container; and exposing the formed container, with the oxygen sensitive product therein, to actinic radiation at a dosage effective to sterilize the container, and trigger the oxygen scavenger in the article.

In a second aspect of the invention, a method comprises providing a container comprising an oxygen scavenger; providing an oxygen sensitive product; placing the oxygen sensitive product into the container; and exposing the container, with the oxygen sensitive product therein, to actinic radiation at a dosage effective to sterilize the container, and trigger the oxygen scavenger in the container.

In a third aspect of the invention, a method comprises providing an article comprising an oxygen scavenger; forming the article into a container; exposing the formed container to actinic radiation at a dosage effective to sterilize the container, and trigger the oxygen scavenger in the article; and placing an oxygen sensitive product into the formed container.

In a fourth aspect of the invention, a method comprises providing an article comprising an oxygen scavenger; providing an oxygen sensitive product; packaging the oxygen sensitive product in a container formed at least in part from the article; and exposing the formed container, with the oxygen sensitive product therein, to actinic radiation at a dosage effective to sterilize the container, and trigger the oxygen scavenger in the article.

In a fifth aspect of the invention, a method comprises providing an article comprising an oxygen scavenger; providing an oxygen sensitive product; exposing the article to actinic radiation at a dosage effective to sterilize the article, and trigger the oxygen scavenger in the article; and packaging the oxygen sensitive product in a container formed at least in part from the article.

In a sixth aspect of the invention, a package comprises a container, the container comprising an activated oxygen scavenger; wherein the container is sterilized, and wherein an oxygen sensitive product is disposed in the container.

In the above-described aspects:

the article is preferably in form of a film, such as a film comprising a layer comprising an oxygen scavenger; and a layer comprising a polymer having an oxygen transmission rate of less than 500 $cm^3/m^2 \cdot day \cdot atm$ (ASTM D 3985-95);

the oxygen scavenger preferably comprises a material selected from the group consisting of:

i) oxidizable organic compound and a transition metal catalyst, ii) ethylenically unsaturated hydrocarbon and a transition metal catalyst, iii) a polymer having a polymeric backbone, cyclic olefinic pendent group, and linking group linking the olefinic pendent group to the polymeric backbone;

iv) a copolymer of ethylene and a strained, cyclic alkylene; and v) ethylene/vinyl aralkyl copolymer;

the article is preferably a pouch, bag, tray, or lidstock;

the oxygen sensitive product is preferably a medical product such as intravenous solution, or a food product;

the oxygen sensitive product is packaged in a container formed at least in part from the article, by preferably i) placing the oxygen sensitive product in a pouch formed from the film containing the oxygen scavenger;

ii) wrapping the oxygen sensitive product in a film containing an oxygen scavenger, and sealing the film to form a hermetic package; or iii) placing the oxygen sensitive product in a tray, covering the tray with a lidstock, and sealing the lidstock to the tray to form a hermetic package, wherein at least one of the tray and the lidstock comprises an oxygen scavenger.

DETAILED DESCRIPTION OF THE INVENTION

The inventor has found that packaging materials can be triggered to scavenge oxygen during a sterilization process typical of those used for health care products (e.g. gamma radiation). One significant advantage is that a packaging structure, especially a high oxygen barrier structure, can be simultaneously sterilized while initiating oxygen scavenging of the oxygen in the interior of a container made in part or entirely from the article, and/or while initiating oxygen scavenging that provides an active barrier to further ingress of oxygen from the exterior of the container. Both of these attributes (sterilizing of the packaging materials and oxygen scavenging) are desirable for product quality, and extended shelf life of oxygen sensitive products. The packaging structure can take the form of a flexible film, laminate, sheet, or web which can be formed into a bag or pouch, or alternatively can take the form of a semi-rigid or rigid tray or container, such as a bottle.

Although the two functions, sterilization and oxygen scavenging, preferably occur simultaneously, those skilled in the art will understand, after a review of the invention disclosed herein, that some amount of time may elapse between the point in time at which sterilization of the packaging material occurs, and the point in time at which oxygen scavenging initiates.

EXAMPLES

One example of a conventional packaging structure requiring oxygen and moisture barrier is a multilayer film construction as follows:

| | | | | | |
|---|---|---|---|---|---|
| (outside of package) | Abuse Resistant Layer | gas barrier layer | Moisture Barrier Layer | sealant layer | (inside of package) |

In accordance with the present invention, an oxygen scavenger can be either added to or combined with the gas barrier layer:

| | | | | | |
|---|---|---|---|---|---|
| (outside of package) | Abuse Resistant Layer | gas barrier + oxygen scavenger layer | Moisture Barrier Layer | sealant layer | (inside of package) |

Alternatively, the oxygen scavenger can be added as a separate layer or layers:

| | | | | | | |
|---|---|---|---|---|---|---|
| (outside of package) | abuse resistant layer | gas barrier layer | moisture barrier layer | oxygen scavenger layer | sealant layer | (inside of package) |

or

| | | | | | | |
|---|---|---|---|---|---|---|
| (outside of package) | abuse resistant layer | gas barrier layer | oxygen scavenger layer | moisture barrier layer | sealant layer | (inside of package) |

Other layers can optionally be included as appropriate, such as one or more adhesive layers, as shown by each of the following three examples:

| | | | | | | | |
|---|---|---|---|---|---|---|---|
| (outside of package) | abuse resistant layer | adhesive layer | gas barrier + oxygen scavenger layer | adhesive layer | moisture barrier layer | sealant layer | (inside of package) |

or

| | | | | | | | | |
|---|---|---|---|---|---|---|---|---|
| (outside of package) | abuse resistant layer | adhesive layer | gas barrier layer | adhesive Layer | moisture barrier layer | oxygen scavenger layer | sealant layer | (inside of package) |

or

| | | | | | | | | |
|---|---|---|---|---|---|---|---|---|
| (outside of package) | abuse resistant layer | adhesive layer | gas barrier layer | adhesive Layer | oxygen scavenger layer | moisture barrier layer | sealant layer | (inside of package) |

A functional barrier layer can optionally be included in the packaging structure:

| | | | | | | |
|---|---|---|---|---|---|---|
| (outside of package) | abuse resistant layer | gas barrier + oxygen scavenger layer | moisture barrier layer | sealant layer | functional barrier | (inside of package) |

or

| | | | | | | | |
|---|---|---|---|---|---|---|---|
| (outside of package) | abuse resistant layer | gas barrier layer | moisture barrier layer | oxygen scavenger layer | sealant layer | functional barrier | (inside of package) |

or

| | | | | | | | |
|---|---|---|---|---|---|---|---|
| (outside of package) | abuse resistant layer | gas barrier layer | oxygen scavenger layer | moisture barrier layer | sealant layer | functional barrier | (inside of package) |

In the above article constructions:

The abuse resistant layer preferably comprises a material such as ethylene/alpha-olefin copolymer, polypropylene, propylene/ethylene copolymer, high density polyethylene, linear low density polyethylene, polyamide, or blends of any of the above;

The gas barrier layer preferably comprises a material such as ethylene/vinyl alcohol copolymer (EVOH), polyvinylidene dichloride, vinylidene chloride/methyl acrylate copolymer, polyamide, polyester; metallized PET, metal foil, and SiOx compounds;

The adhesive layer preferably comprises a material such as an anhydride grafted polymer or copolymer;

The moisture barrier layer preferably comprises a material such as propylene polymer or copolymer, high density polyethylene, ethylene/alpha-olefin copolymer, or ethylene-norbornene copolymer;

The sealant layer preferably comprises a material such as ethylene/alpha-olefin copolymer, ethylene/vinyl acetate copolymer, ethylene/(meth)acrylate copolymer, ethylene/(meth)acrylic acid copolymer, and the like;

The functional barrier layer preferably comprises a material such as those disclosed herein; and The oxygen scavenging layer preferably comprises a material such as those disclosed herein.

For maximum product benefit, the sterilization/initiation process should be carried out prior to product packaging, or immediately after product packaging, depending on the product application. For initiation of the oxygen scavenging reaction, the point in the packaging process or use cycle at which the product is sterilized will affect the configuration of the final packaging structure. For example, packaging products that are triggered a week or more prior to use need to have their oxygen scavenging rate tailored so as to avoid prematurely exhausting their scavenging capacity. This can be accomplished through the use of gas barrier layers flanking the oxygen scavenging layer, or by formulating the oxygen scavenging layer to have a predetermined induction time between triggering and initiation of oxygen scavenging.

Product applications requiring rapid oxygen scavenging would be designed to have oxygen permeable layers between the scavenging layer or layers and the interior (product side) of the package.

Film of the invention can be made by any conventional means, including coextrusion, lamination, extrusion coating, solution coating, or corona bonding, and then optionally oriented. The film can optionally be made heat shrinkable through orientation or tenterframing if desired, at orientation ratios of 1:2 to 1:9 in either or both of the machine and transverse directions. To further increase the ability to shrink it may be desirable to irradiate some of the layers of the structure prior to adding the layers containing the scavenger. For shrink applications, the film can be made to have a free shrink of at least 10%, more preferably at least 20%, most preferably at least 30%, in either or both directions at 90° C.

EXAMPLES

Multilayer films used in the examples were prepared via cast coextrusion. Each of the films had a nine-layer structure and had a total thickness of approximately 7.35 mils.

The materials used in the examples are identified below. All percentages are weight percents unless otherwise indicated. All physical property and compositional values are approximate unless otherwise indicated. In the examples:

"EPC"=Z9540™, a propylene/ethylene copolymer having an ethylene content of about 6 weight percent and a density of about 0.89 g/cc obtained from Fina Oil and Chemical Company.

"SEBS"=KRATON™ G-1652, a styrene-ethylene-butadiene-styrene block copolymer with a specific gravity of about 0.91, obtained from Shell Chemical Company.

"EAO-1"=ENGAGE™ EG 8100, an ethylene-octene copolymer having a density of approximately 0.87 g/cc, a melt index about 1 dg/min and about 24% octene, obtained from the Dow Chemical Company.

"SBS"=VECTOR™ 8508D, a styrene-butadiene-styrene block copolymer with a butadiene content of about 75 wt %, obtained from Dexco.

"CO-NDA"=TEN-CEM™ 170, a cobalt neodecanoate compound with about 22.5 wt % cobalt, obtained from OMG Chemicals.

"EVA"=LD-318.29™, an ethylene-vinyl acetate copolymer with approximately 9 mol % vinyl acetate, a density of 0.930 and melt index about 2.0, obtained from Exxon Chemical Company.

"EAO-2"=EXACT™ 3128, an ethylene/alpha-olefin copolymer with a melt index approximately 1.2 and a density about 0.900, obtained from Exxon Chemical Company.

"APE"=PLEXAR™ 380, an anhydride-modified linear low density polyethylene tie resin with a density of 0.912 and a melt index about 1.5, obtained from Quantum Chemical Company.

"EVOH"=EVAL™ F101A, an ethylene/vinyl alcohol copolymer with approximately 32 mol % ethylene, a density about 1.2 and a melt index about 1.6, obtained from Evalca.

"EMA"=BYNEL™ CXA E374, an anhydride modified ethylene/methyl acrylate copolymer having a melt index of about 2.8 and a density of about 0.931, obtained from E.I. DuPont de Nemours.

"CPE"=ECDEL™ 9965, a copolyester ether having a density about 1.13, obtained from Eastman Chemical Company.

Example 1

A multilayer film in accordance with the present invention had the following 9-layer structure

| Layer | Gauge | Component |
|---|---|---|
| 1 | 75 | 80% EPC/20% SEBS |
| 2 | 40 | 50% EAO-1/40% SBS/10% EVA/680 ppm CO-NDA |
| 3 | 175 | 100% EAO-2 |
| 4 | 40 | 100% APE |
| 5 | 75 | 100% EVOH |
| 6 | 40 | 100% APE |
| 7 | 175 | 100% EAO-2 |
| 8 | 40 | EMA |
| 9 | 75 | CPE |

Example 2

In order to determine the effect of gamma irradiation on the film of Example 1, a film sample was treated with gamma irradiation at an average dose of 39 kGy (3.9 megarads). This dose was selected to be representative of a level useful for sterilization of packaged medical products.

Example 3

Samples of non-irradiated (Example 1) and irradiated (example 2) film were tested for oxygen transmission rate as an indication of oxygen scavenging ability. Oxygen transmission values were obtained using a test method described in detail in U.S. Pat. No. 5,583,047 (Blinka et al.), incorporated herein by reference in its entirety. The results of the test on the two samples at two times are shown in Table 1.

TABLE 1

| Oxygen Transmission Rate, cc/m$^2$/day | | |
|---|---|---|
| Time (hours post irradiation) | Example 1 (non-irradiated) | Example 2 (irradiated) |
| 5 | 0.58 | 0.22 |
| 53 | 0.58 | 0.24 |

This example clearly shows that the multilayer films, when treated with a level of gamma irradiation sufficient to sterilize packaged products, effectively triggered the multilayer films to begin scavenging oxygen. The triggered films show a dramatic reduction in overall oxygen permeability by a factor between 2 and 3 for this example. This degree of permeability decrease would be expected to have a significant, positive effect, on extending the shelf life of oxygen-sensitive package contents.

While the invention has been described with reference to illustrative examples, those skilled in the art will understand that various modification may be made to the invention as described without departing from the scope of the claims that follow.

Various changes and modifications may be made without departing from the scope of the invention defined below. The articles of the present invention have been described primarily in connection with the packaging of medical products. However, it is to be understood that other applications for the articles are also possible, and that this disclosure should not be construed as being limited only to medical products.

What is claimed is:

1. A method comprising:

a) providing a multilayer plastic article comprising an organic oxygen scavenger b) forming the article into a container;

c) placing an oxygen sensitive product into the formed container, and d) exposing the formed container, with the oxygen sensitive product therein, to actinic radiation at a dosage effective to sterilize the container, and trigger the organic oxygen scavenger in the article.

2. The method of claim 1 comprising providing the multilayer plastic article in the form of a film.

3. The method of claim 1 comprising providing the multilayer plastic article in the form of a film, wherein the film comprises:

a) a layer comprising an oxygen scavenger; and b) a layer comprising a polymer having an oxygen transmission rate of less than 500 cm$^3$/m$^2$·day·atm (ASTM D 3985-95).

4. The method of claim 1 comprising providing the multilayer plastic article comprising an oxygen scavenger, wherein the organic oxygen scavenger comprises a material selected from the group consisting of:

i) oxidizable organic compound and a transition metal catalyst, ii) ethylenically unsaturated hydrocarbon and a transition metal catalyst, iii) a polymer having a polymeric backbone, cyclic olefinic pendent group, and linking group linking the olefinic pendent group to the polymeric backbone;

iv) a copolymer of ethylene and a strained, cyclic alkylene; and v) ethylene/vinyl aralkyl copolymer.

5. The method of claim 1 comprising forming the multilayer plastic article into a container, wherein the container is a pouch.

6. The method of claim 1 comprising forming the multilayer plastic article into a container, wherein the container is a bottle.

7. The method of claim 1 comprising placing an oxygen sensitive product into the formed container, wherein the oxygen sensitive product is a medical product.

8. The method of claim 7 comprising placing an oxygen sensitive product into the formed container, wherein the oxygen sensitive product is intravenous solution.

9. The method of claim 1 comprising exposing the formed container, with the oxygen sensitive product therein, to gamma radiation at a dosage of at least 0.2 megarads to sterilize the container, and trigger the oxygen scavenger in the multilayer plastic article.

10. A method comprising:

a) providing a container comprising an organic oxygen scavenger;

b) providing an oxygen sensitive product;

c) placing the oxygen sensitive product into the container, and d) exposing the container, with the oxygen sensitive product therein, to actinic radiation at a dosage effective to sterilize the container, and trigger the organic oxygen scavenger in the container.

11. The method of claim 10 comprising providing a container comprising an organic oxygen scavenger, wherein the organic oxygen scavenger comprises a material selected from the group consisting of:

i) oxidizable organic compound and a transition metal catalyst, ii) ethylenically unsaturated hydrocarbon and a transition metal catalyst, iii) a polymer having a polymeric backbone, cyclic olefinic pendent group, and linking group linking the olefinic pendent group to the polymeric backbone;

iv) a copolymer of ethylene and a strained, cyclic alkylene; and v) ethylene/vinyl aralkyl copolymer.

12. The method of claim 10 comprising providing a container comprising an organic oxygen scavenger, wherein the container is a pouch.

13. The method of claim 10 comprising providing a container comprising an organic oxygen scavenger, wherein the container is a bottle.

14. The method of claim 10 comprising providing a container comprising an organic oxygen scavenger, wherein the container is a tray.

15. The method of claim 10 comprising placing an oxygen sensitive product into the container, wherein the oxygen sensitive product is a medical product.

16. The method of claim 15 comprising placing an oxygen sensitive product into the container, wherein the oxygen sensitive product is intravenous solution.

17. The method of claim 10 comprising exposing the container, with the oxygen sensitive product therein, to gamma radiation at a dosage of at least 0.2 megarads to sterilize the container, and trigger the organic oxygen scavenger in the article.

18. A method comprising:

a) providing an article comprising an oxygen scavenger, b) forming the article into a container;

c) placing an oxygen sensitive product into the formed container; and d) exposing the formed container, with the oxygen sensitive product therein, to actinic radiation at a dosage effective to sterilize the container, and simultaneously trigger the oxygen scavenger in the container.

19. A method comprising:

a) providing a container comprising an oxygen scavenger;

b) providing an oxygen sensitive product;

c) placing the oxygen sensitive product into the container; and d) exposing the container, with the oxygen sensitive product therein, to actinic radiation at a dosage effective to sterilize the container, and simultaneously trigger the oxygen scavenger in the container.

* * * * *